United States Patent [19]

Costello et al.

[11] Patent Number: 4,926,614

[45] Date of Patent: May 22, 1990

[54] PACKAGING METHOD AND APPARATUS

[75] Inventors: Anthony W. Costello, Howick; Graeme J. Ogg, Murrays Bay; John C. McGregor, Mangere, all of New Zealand

[73] Assignee: RMF Steel Products Co., Grandview, Mo.

[21] Appl. No.: 408,442

[22] Filed: Sep. 15, 1989

Related U.S. Application Data

[63] Continuation of Ser. No. 117,287, Nov. 4, 1987.

[30] Foreign Application Priority Data

Nov. 5, 1986 [NZ] New Zealand ..... 218186
Jul. 23, 1987 [NZ] New Zealand ..... 221180

[51] Int. Cl.[5] ..... B65B 31/02; B65B 31/06
[52] U.S. Cl. ..... 53/434; 53/512
[58] Field of Search ..... 53/512, 434, 479, 86, 53/88, 373

[56] References Cited

U.S. PATENT DOCUMENTS

| | | | |
|---|---|---|---|
| 3,659,393 | 5/1972 | Richter | 53/433 |
| 3,832,824 | 9/1974 | Burrell | 53/512 X |
| 3,851,437 | 12/1974 | Waldrop et al. | 53/512 X |
| 4,058,953 | 11/1977 | Sanborn, Jr. et al. | 53/433 |
| 4,541,224 | 9/1985 | Mugnai | 53/512 X |
| 4,578,928 | 4/1986 | Andre et al. | 53/512 |
| 4,583,347 | 4/1986 | Nielsen | 53/512 X |
| 4,744,199 | 5/1988 | Gannon | 53/512 X |

FOREIGN PATENT DOCUMENTS

| | | |
|---|---|---|
| 1184483 | 3/1970 | United Kingdom . |
| 1371778 | 10/1974 | United Kingdom . |

*Primary Examiner*—Horace M. Culver
*Attorney, Agent, or Firm*—Renner, Otto, Boisselle & Sklar

[57] ABSTRACT

In its preferred form the invention comprises a method and apparatus for packaging products such as foodstuffs, whereby the product is held in flexible bag inside a chamber, and the bag is substantially evacuated and then filled with a gas such as carbon dioxide, with pressure in the chamber on the outside of the bag being reduced during the evacuation to prevent entrapment of air in the bag.

6 Claims, 1 Drawing Sheet

PACKAGING METHOD AND APPARATUS

This is a continuation of co-pending application Ser. No. 07/117,287 filed on Nov. 4, 1987.

This invention relates to method and apparatus for packaging, and has particular application to the packaging of spoilable materials, eg. foodstuffs, plants, etc within a bag or the like.

BACKGROUND OF THE INVENTION

Previous methods of packaging spoilable material have involved packing the product within a plastic bag or the like, evacuating the bag, with the outside of the bag exposed to atmospheric pressure as the vacuum is applied, then injecting gas or gas mixture in place of the air.

This has been carried out using vacuum packing machinery. An example of this is described in U.S. Pat. No. 3,939,624. However, that method and other existing vacuum packing systems are not entirely satisfactory for all applications.

A particular problem found with vacuum packing systems where the bag is exposed to atmospheric pressure, is that the moment that vacuum is drawn on the bag, whilst the neck of the bag is clamped about the "snorkel" or other connecting passageway, the bag rapidly collapses under the pressure differential between the atmosphere on the outside of the bag and the partial pressure within the bag. Pockets of air are often trapped within the bag and cannot be evacuated by the passageway, as the bag collapses between the pocket of air and the end of the passageway. Thus if a gas is injected into the bag prior to sealing, it will be mixed with a proportion of air remaining within the bag. This is undesirable, as the remaining air can expose the product, eg meat, to excess oxygen resulting in spoilage.

This problem can be avoided to some extent by providing a snorkel which projects far enough into the bag to contact the product inside, such that the bag can not collapse between the mouth of the snorkel and the product. However, this does not prevent air entrapment at the far corners of the bag or between the bag and the product.

Furthermore, the use of a long snorkel projecting this far into the bag can make sealing of the bag more complicated and time consuming.

SUMMARY OF THE INVENTION

It is an object of this invention to provide an improved packaging method and/or apparatus, or one which will at least provide the food industry with a useful choice.

In one aspect the invention provides apparatus for use in packaging a product, including a chamber capable of holding a flexible container with said product contained therein, said container being closed off with respect to said chamber to separate gas contained in said container from gas contained in said chamber, means for removing gases from said container, means for introducing gases to said container, and means for controlling pressure in said chamber.

Preferably the means for removing gases from the container includes a snorkel, which can in normal use be fitted through an opening in the container.

In another aspect the invention provides a method for packaging a product, including the steps of placing said product in a flexible container, said fexible container being substantially impermeable to oxygen in normal use, evacuation of substantially all gas from said container, release of a selected gas into said container, and sealing of said container to retain said selected gas in said container and substantially prevent infiltration of oxygen into said container, wherein said container is held in apparatus as described above during said evacuation, to provide control over external pressure on said container during said evacuation.

Preferably external pressure on the container is lowered during the evacuation of the container.

Preferably external pressure on the container is lowered to a predetermined level and held at that level, and evacuation of the container is continued beyond that predetermined level, such that the container is collapsed after being evacuated to at least that predetermined level.

In another aspect the invention provides a method of packaging products, including placing the product within a closeable container such as a flexible bag, placing the bag and contents within a chamber, connecting the closeable container to a nozzle, clamping the closeable container about the nozzle to separate its contents from the contents of the chamber, sealing the chamber from the atmoshere, evacuating the container and the chamber to substantially remove all of the air or other gases from the chamber and the closeable container, ceasing evacuation of the chamber but continuing to evacuate the container, such that the container is collapsed, admitting a gas or gas mixture into the closeable container and simultaneously slowly venting the chamber to avoid stress on the container, and sealing the closeable container.

Preferably the container is heat sealed.

Preferably the container can be sealed while connected to the nozzle.

Preferably the chamber can be opened before the container is sealed.

In another aspect, the invention provides apparatus suitable for the packaging method, such apparatus including a closeable chamber, a gas passageway communicating with the interior of the chamber and adapted to be connected to the mouth of a container held in the chamber, said gas passageway capable of being connected to a vacuum source and/or a gas source, means for clamping the neck of a container about the outlet of the passageway, and means for permanently sealing the neck of a bag, further including a gas passageway communicating with the interior of the chamber, and means for controlling flow through said passageways, preferably including pressure switches.

These and other aspects, which should be considered in all its novel aspects will become apparent from the following description, which is given by way of example only, with reference to the accompanying drawing, in which:

DETAILED DESCRIPTION

Figure 1:
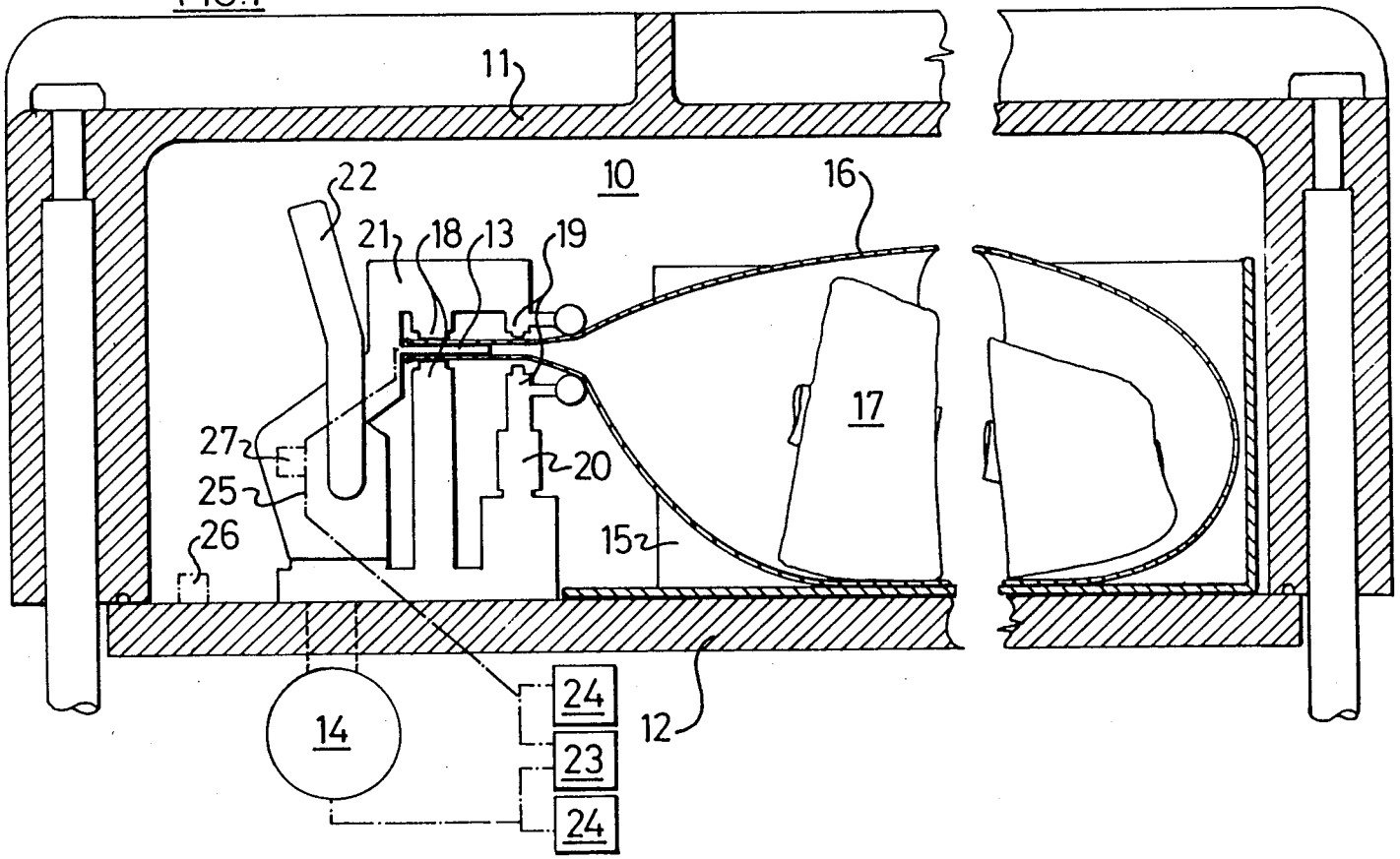
FIG. 1 illustrates a schematic view of a preferred packaging apparatus.

This apparatus includes a chamber 10 defined by a removable cover 11 and a base 12. Gas passages are provided, connecting the apparatus to a vacuum source 23 and one or more gas sources 24. One passage 25 includes a snorkel 13 intended for connection with a container held in the chamber 10, as detailed below, and a second passage 14 provides access to the chamber 10 itself. In some applications, it may be desirable to provide pairs of passageways, one connected to the vacuum source and one to a gas source. Alternatively, as shown single passageways may be used with appropriate valves to switch the passageway between the two functions.

Preferably the chamber 10 is of a size able to comfortably accommodate a box 15 and heat sealable bag 16 with its contents 17.

In its preferred form the apparatus includes clamping and sealing apparatus for the bag 16, inside the chamber 10, separate and independently moveable from the cover 11. This apparatus includes clamping bars 18 mounted around the snorkel 13 for temporarily clamping the mouth of the bag around the snorkel 13, and sealing bars 19 positioned beyond the snorkel 13 for sealing the mouth of bag 16 between the snorkel and the product 17. One or both sealing bars 19 are moveable, preferably by the use of a pneumatic cylinder 20, such that the mouth of the bag can be left open or sealed shut between the snorkel 13 and the product 17. The upper clamping bar 18 and sealing bar 19 can be mounted on a pivotable jaw 21 with a handle 22 by which it may be moved up or down. All this apparatus is contained in the chamber 10 along with the product 17 and its packaging, and is covered by the lid 11. An airtight seal is formed between the lid 11 and the base 12 in normal use.

It is preferable for the clamping bars 18 to be positioned behind the sealing bars 19 as shown, rather than in front of them. If the clamping bars 18 were positioned in front of the sealing bars 19 with the snorkel 13 protruding through them, it would be necessary to withdraw the snorkel before sealing the bag, and furthermore a small pocket of air would inevitably be trapped between the clamping bars and the seal, and would be released into the bag upon removal of the clamping bars. With the arrangement of the present invention the snorkel is not required to move, and there is no air entrapment at the mouth of the bag.

In use, the product 17 to be packed is placed within a heat sealable bag 16 and box 15, and is then placed within the chamber 10. The chamber has appropriate seals about its edge, so that the chamber itself can be evacuated as well as the bag. The bag is placed within the chamber 10 and the mouth of the bag 16 fitted over the snorkel 13. The bag is then clamped off across the snorkel with the pair of clamp bars 18.

The chamber 10 and the bag 16 are evacuated, preferably simultaneously, so that the bag is completely emptied. By controlling the pressure within the chamber as the bag is evacuated, the bag can be controlled so that it does not collapse too soon, cutting off communication between contents and the snorkel 13. Preferably both the chamber and the bag are evacuated from the same source, but the snorkel 13 is narrower than the passageway 14. This means that the chamber is evacuated faster than the bag, and the bag expands inside the chamber as it is emptied, rather than collapsing. This prevents air being trapped in pockets in the bag. Alternatively, the bag and the chamber could be evacuated at the same rate. Even if the bag empties slightly faster than the chamber and collapses as a result, the difference between the air pressure in the bag and the air pressure around it will not be great enough to trap air inside.

When a desired vacuum level in the chamber is achieved, a vacuum pressure switch 26 stops the evacuation and holds the chamber at that vacuum level. The evacuation of the bag continues through the nozzle 13, and the bag collapses as a result. When the desired vacuum level in the bag is reached a second pressure switch 27 is activated. The chamber and the bag are then refilled. The use of pressure switches to turn the system on and off allows the vacuum level to be accurately determined and achieved without undue stress being put on the bag in the process. By using the same vacuum source to evacuate both chamber and bag it is easy to avoid having any great difference between the pressures in each.

To speed up the last stages of evacuation of the bag, it may be found desirable to refill the chamber slightly after activation of the first pressure switch and initial collapse of the bag, to put greater pressure on the bag and squeeze the last of the air out. Such collapsing of the bag could result in entrapment of air, but because the bag is already substantially evacuated at this stage this will in general not be a problem.

The system of the present invention also allows visual checking, in that the bag can be seen to inflate and collapse within the chamber (given one or more windows in the chamber lid or walls) at different times in the process. If, for example, the proper vacuum is not achieved in the bag for any reason, it will not collapse even if a partial reduction of pressure has occurred, because the internal pressure will still be greater than that in the chamber.

When the bag is fully empty, or as empty as the vacuum pump can make it within the desired cycle time, the chamber and the bag are refilled, preferably at the same rate. This time the bag is filled with a selected gas or gas mixture introduced through the nozzle 13. In the case of packaging meat the gas is commonly carbon dioxide, although other gases or gas mixtures may be used. Depending upon the nature of the contents of the bag other gas mixtures may be used to control the storage, ripening, or other qualities of the item stored within the bag.

While the bag is being filled with a gas or gas mixture, the chamber is also filled, most conveniently with air, although other gases could be used. By filling the chamber at a controlled rate at the same time as filling the bag, it is possible to balance the pressure between the gas within the bag, and the air within the chamber. This allows the bag to be filled accurately with a metered quantity of gas, and also avoids undue pressure being placed on the bag.

When atmospheric pressure has been reached in the chamber, the cover 11 of the chamber can be removed, and the sealing bars 19 brought together to seal the bag 16. If two chambers are used together, the cover 11 can be shifted to the second chamber at this stage, and evacuation of another bag commenced while the first is being sealed. When the bag is sealed, the clamping bars 18 can be released and the bag removed from the chamber.

The invention has the advantage that the bag can be well evacuated to leave a very low amount of residual air, and then accurately filled with a known quantity of gas, and avoids the disadvantages or prior vacuum packaging methods in which the bag is exposed to atmospheric pressure during the vacuum and gas flushing operations. The invention also has the advantage that only the bag is filled with the required amount of gas, and no gas is allowed to escape into the chamber. It is also believed that the bags are less likely to be damaged in the operation as there can be little or no stress on the bag during filling.

Finally, it will be appreciated that various alterations or modifications maybe made to the foregoing without departing from the spirit or the scope of this invention, as exemplified by the following claims:

What is claimed is:

1. A method for packaging a product in a flexible container, said method including the steps of:

placing the product within a flexible container having a closable opening, the flexible container being substantially impermeable to oxygen in normal use, attaching the flexible container to a snorkel having a first gas passageway and closing the opening of the container about the snorkel by a pair of elongate clamping elements so that the first gas passageway communicates with the interior of the then closed container, providing a pair of elongate sealing members adjacent the clamping elements but beyond the end of the snorkel, closing a chamber about the flexible container to contain the snorkel, the clamping elements, the sealing members, and the flexible container so that the flexible container is entirely contained within the chamber but is isolated from gas within the chamber by the flexible container being closed about the snorkel, controlling the evacuation of gas from within the chamber and substantially simultaneously evacuating the flexible container via the first gas passageway to control the evacuation of the flexible container and prevent premature collapsing of the flexible container to substantially entirely remove all of the gas from within the flexible container, and injecting a selected gas into the flexible container, and at the same time refilling the chamber with air or other gas, sealing the flexible container and removing the flexible container from the snorkel.

2. A method for packaging a product as claimed in claim 1, wherein the gas within the chamber is initially removed at a greater rate than the gas from within the flexible container in order to maintain a slight pressure differential between the interior and the exterior of the flexible container to prevent premature collapsing of the flexible container.

3. A method for packaging a product as claimed in claim 2, wherein withdrawal of gas from the chamber is stopped when the pressure within the chamber is reduced to a required level, and withdrawal of gas from within the flexible chamber is continued so that the pressure differential across the flexible container is reversed, and the flexible container is allowed to collapse to substantially remove any remaining gas from within the flexible container.

4. A method of packaging a product as claimed in claim 3, wherein the substantially evacuated flexible container is refilled with a controlled amount of carbon dioxide.

5. Apparatus for use in packaging a product in a flexible container comprising:

a chamber, means for closing said chamber, means for holding within said chamber a flexible container containing the product, a snorkel within said chamber, said snorkel having an open end for insertion into an opening in said container, a first gas passageway extending from said snorkel and providing communication between the interior of the flexible container and a first valve means, said first valve means being switchable between a vacuum source for the controlled removal of gas from the chamber and a gas source for the introduction of gas into the chamber, container closing means within said chamber having a closed position for closing off the container about said first gas passageway to isolate the product and any original gas contained in the container from gas contained in said chamber about the container, and an open position allowing placement or removal of the container, said container closing means consisting of a pair of elongate clamping means which can in normal use temporarily close said opening in the container around said first gas passageway so that at least a portion of the snorkel protrudes beyond the clamping means and remains in communication with the interior of the container when said clamping means is in the closed position prior to sealing of the container, and sealing means within the chamber positioned beyond the end of said snorkel which can in normal use seal said opening in the container between the end of the snorkel and the product, said sealing means consisting of a pair of elongate sealing members, a second gas passageway providing communication between that portion of the interior of the chamber which surrounds the container and a second valve means, said second valve means being switchable between a vacuum source for the controlled removal of gas from the chamber and a gas source for the introduction of gas into the chamber, first pressure-sensing means for sensing the gas pressure within the container, and second pressure-sensing means for sensing the gas pressure within said chamber about the container, whereby in use the chamber can be evacuated by means of the second gas passageway while the container can be evacuated by means of the first gas passageway to substantially remove all of the original gas from within the container.

6. Apparatus for use in packaging a product as claimed in claim 5, wherein one of said pair of clamping means and one of said pair of sealing members are mounted on a clamping member which can be moved away from the snorkel so that in use the flexible container can be moved relative to said snorkel and its opening closed off about said snorkel by movement of said clamping member to clamp the flexible container between the pair of clamping means.

* * * * *